US005389282A

United States Patent [19]

Saijo et al.

[11] Patent Number: 5,389,282

[45] Date of Patent: Feb. 14, 1995

[54] MILKY DETERGENT COMPOSITION FOR HARD SURFACES

[75] Inventors: Hiroyuki Saijo; Haruki Kawano, both of Utsunomiya; Masaki Tosaka, Oyama, all of Japan

[73] Assignee: Kao Corporation, Tokyo, Japan

[21] Appl. No.: 203,478

[22] Filed: Feb. 28, 1994

Related U.S. Application Data

[63] Continuation of Ser. No. 871,916, Apr. 22, 1992, abandoned.

[30] Foreign Application Priority Data

Apr. 24, 1991 [JP] Japan ..... 3-094184
Oct. 3, 1991 [JP] Japan ..... 3-256699

[51] Int. Cl.[6] ..... C11D 1/66; C11D 1/75

[52] U.S. Cl. ..... 252/174.17; 252/544; 252/547; 252/DIG. 1; 252/DIG. 14

[58] Field of Search ..... 252/174.17, 544, 547, 252/DIG. 14, DIG. 1

[56] References Cited

U.S. PATENT DOCUMENTS 4,732,704 3/1988 Biermann et al. ..... 252/548
5,025,069 6/1991 Deguchi et al. .
5,073,293 12/1992 Deguchi et al. ..... 252/174.17
5,154,850 10/1992 Deguchi et al. ..... 252/174.17
5,230,835 7/1993 Deguchi et al. ..... 252/550

FOREIGN PATENT DOCUMENTS 0070074 1/1983 European Pat. Off. .
0347110 12/1989 European Pat. Off. .
0374702 6/1990 European Pat. Off. .
0388810 9/1990 European Pat. Off. .
1-304198 12/1989 Japan .

OTHER PUBLICATIONS

Database WPIL, An 91-264095, JP-A-3 174 496, Jul. 29, 1991.
Database WPIL, An 90-026321, JP-A-1 304 198, Dec. 7, 1989.
Database WPIL, An 92-020327, JP-A-3 269 097, Nov. 29, 1991.
Database WPIL, An 91-188997, JP-A-3 115 497, May 16, 1991.

*Primary Examiner*—Paul Lieberman
*Assistant Examiner*—Michael P. Tierney
*Attorney, Agent, or Firm*—Oblon, Spivak, McClelland, Maier & Neustadt

[57] ABSTRACT

A milky detergent composition for hard surfaces comprising the following components (a) and (b):

(a) 1–50 wt. % of an alkylglycoside; and (b) 1–30 wt. % of one or more compounds selected from the group consisting of:

(b-1) lipids selected from hydrocarbons, higher alcohols, fatty acids, waxes, cholesterol and cholesterol esters and having a melting point of 30° C. or higher;

(b-2) partial esters of aliphatic hydrocarbon polyols having a melting point of 30° C. or higher and 2–9 carbon atoms with fatty acids having at least 13 carbon atoms on the average; and (b-3) partial ethers of aliphatic hydrocarbon polyols having a melting point of 30° C. or higher and 2–9 carbon atoms with aliphatic hydrocarbons having at least 13 carbon atoms on the average the proportion of the component (b) to the component (a) ranging from 1/10 to 10/1 by weight, optionally containing at least one nitrogen-containing surfactant and/or an anionic surfactant.

20 Claims, No Drawings

MILKY DETERGENT COMPOSITION FOR HARD SURFACES

This application is a continuation of application Ser. No. 07/871,916 , filed on Apr. 22, 1992, now abandoned.

BACKGROUND OF THE INVENTION.

1. Field of the Invention

This invention relates to a milky detergent composition for hard surfaces, and more particularly to a milky detergent composition for hard surfaces which does not irritate or damage the user's skin, has excellent foam producing ability (hereinafter referred to as "foamability") and detergency, gives a pleasant feel to the user's hands after washing, and is particularly suitable for use in cleansing tableware.

2. Description of the Background Art

In general, detergents suitable for use in washing items having hard surfaces such as tableware have as their principal object the removal of oil and/or grease smears. In most cases, users remove oil and grease smears by causing a detergent to foam by moving their hands or a sponge upon the hard surface. The foam serves to lessen the force required to remove the oil and/or grease smears and, generally, the volume of foam generated is a measure of the detergent's cleansability. Therefore, an important factor in such detergents is that they have high foamability. In conventional detergents for hard surfaces, an anionic surfactant such as an alkylbenzene-sulfonate, alpha-olefinsulfonate, alkylsulfate, paraffin-sulfonate or ethoxylated alkyl ether sulfate is used as the principal surfactant. Among these, sodium alkylbenzenesulfonates have been widely used as a base material having excellent cleansability. However, these surfactants suffer from a significant drawback: they have a strong delipidizing power on the user's skin that causes hand roughening. Accordingly, detergent compositions comprising, as a main detergent base material, a salt of a polyoxyethylene alkyl ether sulfuric ester, which is somewhat milder to the user's skin, have come to predominate in recent years. However, the action of even these later detergent compositions on the user's skin is short of wholly satisfactory even though they are milder than conventional detergent compositions.

On the other hand, it is known that an alkylglycoside, which is a nonionic saccharide-derived surfactant, is a low-irritative surfactant and, moreover, not only produces stable foam by itself but also acts as a foam stabilizer for other anionic surfactants. Japanese Patent Application Laid-Open No. 104625/1983 (corresponding to EP 70074) describes a foaming surfactant composition comprising an alkylglycoside and an anionic surfactant, and Japanese Patent Application Laid-Open No. 74999/1987 (corresponding to EP 216301 and U.S. Pat. No. 4,732,704) describes a liquid detergent composition for cleansing tableware, which comprises an alkylglycoside, an anionic surfactant and a fatty acid alkanolamide.

Further, Japanese Patent Application Laid-Open No. 164819/1990 (corresponding to EP 374702 and U.S. Pat. No. 5,025,069) describes a detergent composition which comprises an alkylglycoside, an anionic surfactant, an amine oxide and an ethylene oxide adduct of a nonionic surfactant which shows good foamability and detergency, and is in easily rinsed. In Japanese Patent Application Laid-Open No. 304198/1989, there is described a detergent for hard surfaces, which comprises an alkylglycoside and a fatty acid ester of a trihydric or still higher polyhydric alcohol which is excellent in foamability and detergency, and gives a good results after washing. All of these detergent compositions, however, are of the transparent solution type, and hence these references neither disclose nor suggest the present invention. Furthermore, while these reference compositions are superior in their various properties to conventional detergents comprising, as a main material, a polyoxyethylene alkyl ether, they are generally unsatisfactory, particularly in their feel given to the user's hands after washing and in their mildness towards delicate hands and skin.

There has thus been a demand for the development of a detergent composition for hard surfaces which is excellent in detergency and foamability, is low-irritative, and gives a pleasant feel to the user's hand skin after washing.

SUMMARY OF THE INVENTION

In view of the foregoing circumstances, the present inventors have carried out an extensive investigation with a view towards developing a detergent free from the above drawbacks and using an alkylglycoside to its best advantage. As a result, it has surprisingly been found that when one or more compounds selected from the group consisting of lipids having a melting point of 30° C. or higher, partial esters of aliphatic hydrocarbon polyols having a melting point of 30° C. or higher and partial ethers of said polyols, which materials are scarcely incorporated into detergents in general, are added to an alkylglycoside any irritation to the skin is relieved, a pleasant feel is given to the user's hand skin after washing, and both the foamability and detergency of the alkylglycoside remains. It has also been found that the combined use of an amine oxide with one or more of the above-described compounds provides an improvement of the foregoing effects. The present invention was led to completion by these findings.

In an aspect of this invention, there is thus provided a milky detergent composition for hard surfaces, which comprises the following components (a) and (b):

(a) 1–50 wt. % of an alkylglycoside; and (b) 1–30 wt. % of one or more compounds selected from the group consisting of:

(b-1) lipids selected from hydrocarbons, higher alcohols, fatty acids, waxes, cholesterol and cholesterol esters and having a melting point of 30° C. or higher;

(b-2) partial esters of aliphatic hydrocarbon polyols having 2–9 carbon atoms with fatty acids having at least 13 carbon atoms on the average, said esters having a melting point of 30° C. or higher; and (b-3) partial ethers of aliphatic hydrocarbon polyols having 2–9 carbon atoms with fatty acids having at least 13 carbon atoms on the average, said ethers having a melting point of 30° C. or higher;

the proportion of said component (b) to said component (a), that is, the ratio of (b)/(a), ranging from 1/10 to 10/1 by weight.

In another aspect of this invention, there is also provided a milky detergent composition for hard surfaces which comprises the following components (a) through (d):

(a) 1–40 wt. % of an alkylglycoside represented by (1) the following general formula (1):

$$R^1(OR^2)_xG_y \quad (1)$$

wherein $R^1$ means a linear or branched alkyl, alkenyl or alkylphenyl group having 8–18 carbon atoms, $R^2$ denotes an alkylene group having 2–4 carbon atoms, G represents a residue derived from a reducing sugar having 5–6 carbon atoms, x stands for a number of 0–5 and is an average value, and y is a number of 1.0–1.42, and is an average value;

(b) 1–20 wt. % of a glyceride in which the fatty acid residue has 16–24 carbon atoms whose content of monoglyceride is 75–100%;

(c) 1–20 wt. % of a nitrogen-containing surfactant; and (d) 1–40 wt. % of an anionic surfactant, the sum of said components (a), (c) and (d) being 5–40 wt. %, and the proportion of said component (b) to the sum of said components (a), (c) and (d), that is, the ratio (b)/[(a)+(c) +(d)], being 0.05–1 by weight.

These and other objects and advantages of the present invention will become apparent from the preferred embodiments of this invention, which will be described subsequently in detail.

DETAILED DESCRIPTION OF THE PREFERRED EMBODIMENTS

The term "milky" as used herein describes a state wherein any of the components (b) above are dispersed as solid fine particles in an aqueous phase. The detergent composition according to this invention thus differs from an emulsion in which a liquid oil is dispersed as fine particles in an aqueous phase.

The alkylglycoside, i.e., component (a), is used as a main surfactant in this invention and may include those represented by the following general formula (1):

$$R^1(OR^2)_xG_y \quad (1)$$

wherein $R^1$ means a linear or branched alkyl, alkenyl or alkylphenyl group having 8–18 carbon atoms, $R^2$ denotes an alkylene group having 2–4 carbon atoms, G represents a residue derived from a reducing sugar having 5–6 carbon atoms, x stands for a number of 0–5 and is an average value, and y stands for a number of 1–10 and is an average value.

Referring to formula (1), $R^1$ is a linear or branched alkyl, alkenyl or alkylphenyl group having 8–18 carbon atoms. However, the number of carbon atoms is preferably 10–14 from the viewpoint of solubility, foamability and cleansability. Further, $R^2$ is an alkylene group having 2–4 carbon atoms, with an alkylene group having 2–3 carbon atoms being preferred from the viewpoint of the solubility in water and the like. Furthermore, the structure of G is dependent upon the raw material to be used, which raw material is a monosaccharide or di- or higher polysaccharide. Examples of the raw material for G are monosaccharides such as glucose, fructose, galactose, xylose, mannose, lyxose and arabinose; disaccharides and higher polysaccharides such as maltose, xylobiose, isomaltose, cellobiose, gentiobiose, lactose, sucrose, nigerose, turanose, raffinose, gentianose and melezitose; and mixtures thereof. Of these, the preferred materials are glucose and fructose for the monosaccharides, and maltose and sucrose for the di- or higher polysaccharides because of their availability and low cost.

x is a number of 0–5 and is an average value. Both the water-solubility and crystallinity of the alkylglycoside are controlled by this value. Namely, the alkylglycoside has an inclination towards higher water-solubility and lower crystallinity as x increases. The value of x is preferably 0–2. Further, y is a number of 1–10 and is an average value. The average value of y is preferably about 1.0–3.0, particularly preferably 1.0–1.42. Furthermore, when y is greater than 1 a surfactant represented by the general formula (1) and containing a di- or higher polysaccharide chain as a hydrophilic group is produced. The bond form of the saccharide chain may be a 1–2, 1–3, 1–4 or 1–6 bond, or an alpha- or beta-pyranoside or furanoside bond. It is also possible for a chain of several saccharides to contain a number of these bond types, and for the average alkylglycoside of formula 1 to encompass separate species each with different bond types/series. The measurement of y in this invention is based on the proton NMR method.

The above-mentioned alkylglycosides useful as component (a) may be used either singly or in combination. Component (a) is incorporated into the detergent composition of this invention in a proportion of 1–50 wt % preferably 1–40 wt. %, more preferably 5–30 wt. %, most preferably 5–20 wt. %. Any proportions lower than 1 wt. % result in a composition which fails to satisfy the basic performance; excellent foamability and detergency. On the other hand, any proportions exceeding 50 wt. % are accompanied by another problem; the viscosity of the resulting composition is remarkably increased and it becomes difficult to eject the composition from a container charged with the composition.

Referring to component (b) in this invention, examples of the lipids (b-1) having a melting point of 30° C. or higher, preferably 50° C. or higher include hydrocarbons such as n-eicosane, n-pentacosane and paraffins; higher alcohols having at least 14 carbon atoms; fatty acids such as lauric acid, stearic acid and hydroxystearic acid; waxes typified by lanolin and beeswax; cholesterol; and cholesterol esters such as cholesterol stearate.

Further, referring to the component (b), examples of the partial esters (b-2) of C2-C9 aliphatic hydrocarbon polyols, said esters having a melting point of 30° C. or higher, preferably 50° C. or higher, and the partial ethers (b-3) of said polyols include partial esters and partial ethers of glycerol, ethylene glycol, propylene glycol, and of dimers and trimers of glycerol, ethylene glycol and propylene glycol. Partial esters with fatty acids having at least 16 carbon atoms on the average, such as glyceryl monopalmitate, glyceryl monostearate, ethylene glycol monostearate and diethylene glycol monostearate are particularly preferred. Partial esters of glycerol with fatty acids are most preferred.

Partial ethers of the above aliphatic hydrocarbon polyols with aliphatic hydrocarbons having at least 13 carbon atoms on the average include ethers made from compounds of the formula RX where R is a $C_{13}$–$C_{25}$ linear or branched hydrocarbon, preferably a $C_{16}$–$C_{20}$ linear or branched hydrocarbon, where X is a reactive ether-forming group such as halide, tosyl, etc.

Since glycerides are also one component of sebum, when a glyceride is incorporated in a specific proportion into the composition according to this invention, it remains in the skin after such a composition is used, gives the user a moist feeling upon use and serves the function of protecting the hands and skin. Glycerides having a high hydrophobic nature are preferred in order for this component to remain in the skin. However, the use of glycerides that are high in their triglyceride and/or diglyceride content and strong in their hydrophobic nature result in a composition which is deteriorated in suspension stability, and hence has less than optimum detergency and foamability, and moreover gives the user a strong feeling of oiliness and a generally disagreeable feel upon use. Therefore, it is preferable to use glycerides well balanced between hydrophobic and hydrophilic natures, namely, those in which the fatty acid residue has 16–24, particularly 16–22 carbon atoms whose content of monoglyceride is 75–100 wt. %.

It is essential for these components (b-1) through (b-3) to have a melting point of 30° C. or higher, preferably 50° C. or higher. If the melting point is lower than 30° C., most of the composition flows upon rinsing after washing, such that it is impossible to provide a composition that remains on the surface of the skin so as to give a pleasant feel to the user's hands and skin after washing.

Component (b) is incorporated into the composition of this invention in a proportion of 1–30 wt. %, preferably 1–20 wt. %, more preferably 3–20 wt. %, most preferably 3–15 wt. % in total. When the total proportion of b is lower than 1 wt. %, the relative proportion of component (b) dissolved in component (a) becomes high, so that the amount of the component (b) that remains on the surface of the skin after washing is small, leading to a failure of the detergent to give an agreeable feel to the user's hands and skin after washing. On the other hand, any proportions higher than 30 wt. % are not preferred because the resulting composition gives user a strong feeling of oiliness, and poses a problem that the viscosity of the composition is remarkably increased.

Further, in view of detergency and frothing, the proportion by weight of the component (b) to the component (a) [(b)/(a)] in the composition according to this invention is preferably 1/10 to 10/1, more preferably ⅓ to 5/1, with weight ratios higher than ½ but not higher than 5/1 being particularly preferred.

When one or more nitrogen-containing surfactants elected from the group consisting of fatty acid amides, amine oxides, sulfobetaines, carbobetaines and alkylamides, as a further component (c), is incorporated into the composition of this invention, any general irritation and/or damage to the skin caused by surfactants are relieved to an even greater extent and the duration of foaming is significantly improved.

The nitrogen-containing surfactant as component (c) is a surfactant containing one or more nitrogen atoms in its molecule. As specific examples thereof, the following surfactants may be mentioned:

(1) Amides represented by the following general formula (2):

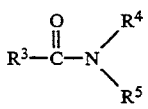

(2)

wherein $R^3$ means a linear or branched alkyl group having 8–18 carbon atoms, and $R^4$ and $R^5$ may be identical to or different from each other and denote individually an atom or group selected from a hydrogen atom, alkyl groups having 1–3 carbon atoms, alkanol groups having 1–3 carbon atoms, $-(C_2H_4O)_{1-6}H$ groups and mixtures thereof.

(2) Amine oxides represented by the following general formula (3):

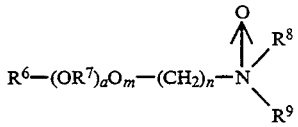

(3)

wherein $R^6$ means a linear or branched alkyl or alkylamide group having 8–18 carbon atoms, $R^7$ denotes an alkylene group having 2–3 carbon atoms, a, m and n stand for numbers of 0–30, 0–1 and 0–5, respectively, and $R^8$ and $R^9$ may be identical to or different from each other and are selected from the group consisting of alkyl groups having 1–3 carbon atoms, alkanol groups having 1–3 carbon atoms, $-(C_2H_4O)_{1-6}H$ groups and mixtures thereof.

(3) Sulfobetaines represented by the following general formula ( 4 ):

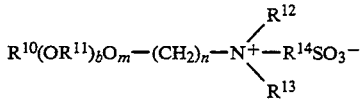

(4)

wherein $R^{10}$ means a linear or branched alkyl or alkylamide group having 8–18 carbon atoms, $R^{11}$ denotes an alkylene group having 2–3 carbon atoms, b, m and n stand for numbers of 0–30, 0–1 and 0–5, respectively, $R^{12}$ and $R^{13}$ may be identical to or different from each other and are individually selected from the group consisting of alkyl groups having 1–3 carbon atoms, alkanol groups having 1–3 carbon atoms, $-(C_2H_4O)_{1-6}H$ groups and mixtures thereof, and $R^{14}$ denotes an alkylene group which may or may not contain an OH group and has 2–5 carbon atoms.

(4) Carbobetaines represented by the following general formula (5):

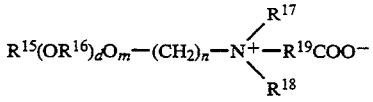

(5)

wherein $R^{15}$ means a linear or branched alkyl or alkylamide group having 8–18 carbon atoms, $R^{16}$ denotes an alkylene group having 2–3 carbon atoms, d, m and n stand for numbers of 0–30, 0–1 and 0–5, respectively, $R^{17}$ and $R^{18}$ may be identical to or different from each other and are selected from the group consisting of alkyl groups having 1–3 carbon atoms, alkanol groups having 1–3 carbon atoms, $-(C_2H_4O)_{1-6}H$ groups and mixtures thereof, and $R^{19}$ denotes an alkylene group which may or may not contain an OH group and has 1–5 carbon atoms.

(5) Alkylamides represented by the following general formula (6):

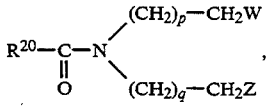

(6)

wherein $R^{20}$ means a linear or branched alkyl group having 8–18 carbon atoms, p and q stand individually for a number of 0–4, and W and Z may be identical to or different from each other and denote individually a hydrogen atom, OH group, -COOM[1] or -$SO_3M^2$, in which $M^1$ and $M^2$ mean individually a hydrogen alkali metal or alkaline earth metal atom, or alkanolamine group.

These nitrogen-containing surfactants may be used either singly or in combination.

The component (c) may be incorporated into the detergent composition in a proportion of 1–20 wt % preferably 1–10 wt. %, more preferably 2–10 wt. %.

Of these (c) ingredients, the amine oxides are particularly preferred. Examples of desirable amine oxides include those represented by the following general formula (7):

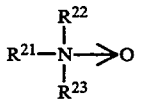

(7)

wherein $R^{21}$ means a linear or branched alkyl or alkenyl group having 8–16 carbon atoms, and $R^{22}$ and $R^{23}$ denote individually a methyl or ethyl group.

Referring to the general formula (7), the number of carbon atoms in $R^{21}$ is 8–16 with 10–14 being preferred.

When at least one anionic surfactant is incorporated into the composition of this invention as a still further component (d), the detergency of the component is improved.

No particular limitation is imposed on the anionic surfactant as the component (d) useful in the practice of this invention and any anionic surfactants may be used so long as they have good compatibility with the component (a), etc. Illustrative anionic surfactants suitable for use as the component (d) are as follows. (1) Polyoxyalkylene alkyl ether sulfates or alkylsulfates represented by the following general formula ( 8 ):

$$R^{24}O(R^{25}O)_rSO_3M^3 \quad (8)$$

wherein $R^{24}$ means an alkyl or alkenyl group having 10–18 carbon atoms, $R^{25}$ denotes an alkylene group having 2–4 carbon atoms, r stands for a number of 0–7, and $M^3$ represents an alkali metal or alkaline earth metal atom, ammonium ion, or alkanolamine-group.

(2) Alkylbenzene sulfonates represented by the following general formula (9):

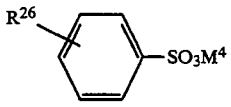

(9)

wherein $R^{26}$ means an alkyl or alkenyl group having 8–18 carbon atoms, and $M^4$ denotes an alkali metal or alkaline earth metal atom, ammonium ion, or alkanolamine group.

(3) Salts of alpha-sulfofatty acid esters, which are represented by the following general formula (10):

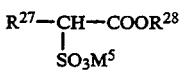

(10)

wherein $R^{27}$ means an alkyl or alkenyl group having 8–18 carbon atoms, $R^{28}$ denotes an alkyl group having 1–3 carbon atoms, and $M^5$ represents an alkali metal or alkaline earth metal atom, ammonium ion, or alkanolamine group.

(4) Alpha-olefinsulfonates having 10–18 carbon atoms and having alkali metal, alkaline earth metal, ammonium and alkanolamine groups, and the like.

(5) Alkanesulfonates having 10–18 carbon atoms and having alkali metal, alkaline earth metal, ammonium and alkanolamine groups, and the like.

These anionic surfactants may be used either singly or in combination.

The component (d) is preferably incorporated into the detergent composition of this invention in a proportion of 1–40 wt. %, particularly 5–20 wt. %.

In the detergent compositions according to this invention, it is desirable to control the proportion of the above-described four components so as to improve the retention of the component (b) in the skin and not to impair the detergency and foamability, which are basic to the performance of the present compositions as detergents.

Namely, the total proportion of the components (a), (c) and (d) is preferably 5–40 wt %, more preferably 10–40 wt % most preferably 10–30 wt. %. Any proportions lower than 5 wt. % result in a detergent composition insufficient in detergency and foamability. On the other hand, any proportions exceeding 40 wt. % result in a detergent composition having a tendency for its suspension stability to deteriorate.

Further, the components (a) through (d) are required to meet the requirement that (b)/[(a)+(c)+(d)] is 0.05–1 by weight. Any weight ratios lower than 0.05 results in a detergent composition with lowered retention of component (b) by the skin. On the other hand, any weight ratios exceeding 1 result in a detergent composition impaired in detergency and foamability. It is hence unpreferable to add the individual components outside the above range. A particularly preferred range is 0.1–0.5.

The detergent compositions of this invention may optionally contain various components other than the essential components described above, so long as they do not impair the intended performance of the present detergent composition. As examples of addable surfactants, nonionic surfactants such as polyoxyethylene alkyl ethers and polyoxyethylene alkyl phenyl ether may be mentioned. As examples of solubilizing agents used in liquid detergents, lower alcohols such as ethanol and isopropanol; polyhydric alcohols such as ethylene glycol, propylene glycol, glycerol and sorbitol; and aromatic sulfonates such as p-toluenesulfonates and mxylenesulfonates may be mentioned. Perfumes, colorants, antiseptic and mildew proofing agents, thickening agents and the like may also be added as desired.

The milky detergent compositions for hard surfaces according to the present invention are excellent in cleansability and foamability, free from readhesion of smears and the occurrence of hand roughening, and give a pleasant feel to the user's hands and skin after washing. Further, they give users a mild feeling because of their milky constitution. The compositions of this invention are particularly suitable for use in cleansing tableware by hand. However, they can be used in washing all hard surfaces such as those found on cooking utensils, in bathrooms, on floors, walls, glasses, furniture, toilet stools, cars, etc.

The present invention will hereinafter be described more specifically by the following exemplary embodiments. However, it should be borne in mind that this invention is not to be limited by the following examples.

EXAMPLES

Tests as to the foamability, detergency and hand feeling after washing, which were adopted in Examples 1 and 2, will first be described.

(1) Foamability test

A commercially-available butter was added in an amount of 1.0 wt. % as a smear component to a 1.0 wt. % aqueous solution of each of the detergent compositions (hardness of water used: 3.5° DH) to determine the foamability at this time. The determination was conducted in the following manner. A glass cylinder 5 cm across was charged with 40 ml of the detergent solution with the butter added thereto. The solution was rotationally stirred for 15 minutes at 40° C. to measure the height of foam generated right after stopping the stirring. The foamability of the detergent composition was evaluated according to the following criteria:

A: 50 mm or higher;

B: not lower than 20 mm but lower than 50 mm; and

C: lower than 20.

(2) Evaluation of detergency

To beef tallow was added 0.1% of Sudan III (a red coloring matter), and a porcelain dish (diameter: 25 cm) coated with 2.5 g of this mixture was rubbed and washed at 20° C. by means of a sponge with 3 g of a detergent and 27 g of water of 3.5° DH hardness soaked therein. The number of dishes cleansed until the beef tallow was not cleanly removed was determined and the detergency was evaluated according to the following criteria:

A: 4 or more dishes;

B: 1–3 dishes; and

C: less than 1 dish.

(3) Evaluation of hand feel after washing:

Two kinds of detergents, A and B were provided to prepare respective 10% aqueous solutions of the detergents at 40° C. in 2-liter beakers.

Both left and right hands were immersed to their wrists in the aqueous solutions of Detergents A and B, respectively. Upon elapsed time of 15 minutes after the immersion, the hands were thoroughly rinsed and then dried with a dry towel. Five minutes later, the feeling of the hands was evaluated on the basis of Detergent A according to the following evaluation marks:

+2: Detergent B had a moister feeling or Detergent A had a drier feeling;

+1: Detergent B had a somewhat moister feeling or Detergent A had a somewhat drier feeling;

±0: Comparable;

−1: Detergent B had a somewhat drier feeling or Detergent A had a somewhat moister-feeling; and −2: Detergent B had a drier feeling or Detergent A had a moister feeling.

The above-described test was conducted on ten panelists, and the feeling upon use of Detergent B was evaluated by the sum total of marks obtained in accordance with the following criteria:

A: +7 to +20;

B: −6 to +6; and

C: −20 to −7.

EXAMPLE 1

Detergent compositions for hard surfaces, which had their corresponding compositions shown in Tables 1, 2, 3, 4 and 5, were prepared, and the foamability test, and the evaluation of detergents and hand feel after washing were conducted on each of the resulting detergent compositions. The results are shown in Tables 1, 2, 3, 4 and 5.

In the evaluation of hand feel after washing, comparative detergent composition No. 8 (Table 5) was used as Detergent A (control) to carry out the comparison tests between the inventive detergent compositions Nos. 1–11 and the control and the comparative detergent compositions Nos. 1–8 and the control.

TABLE 1

| | | | | (wt %) Compositions of Invention | | |
|---|---|---|---|---|---|---|
| | | | | 1 | 2 | 3 |
| Component (a) | | | | | | |
| Alkylglycoside | $R^1$ | x | y | | | |
| [The general | $C_{9-11}$ | 0 | 1.3 | 14 | 14 | 14 |
| formula (1)] | $C_{12-13}$ | 0 | 1.8 | | | |
| Component (b) (melting point) | | | | | | |
| Carnauba wax (80–88) | | | | 10 | | |
| Hydroxy stearate (80–81) | | | | | | |
| Myristyl Alcohol (36–40) | | | | | 10 | |
| Hydrogenated lard ($C_{16-18}$) | | | | | | 10 |
| monoglyceride (63–80) | | | | | | |
| β-Monoolein (35.5) | | | | | | |
| Ethylene glycol distearate (60–65) | | | | | | |
| Cholesterol linolate (39–41) | | | | | | |
| Beeswax (60–67) | | | | | | |
| Other components (melting point) | | | | | | |
| Squalane (<0) | | | | | | |
| Linoleic acid (−5) | | | | | | |
| Lauryl alcohol (22–25) | | | | | | |
| β-monolinolein (12.3) | | | | | | |
| Other components | | | | | | |
| Amine oxide | | | | | 1.5 | 2.0 |
| [The general formula (7): $R^{21} = C_{12}$, $R^{22} = R^{23} = C_1$ | | | | | | |
| Polyoxyethylene (6.0) alkyl ether [alkyl group: $C_{12}$, HLB = 11.7] | | | | | | |
| Polyoxyethylene (3.0) alkyl ether sulfate [alkyl group: $C_{12}/C_{13}$-1/1] | | | | | | |
| Solbitol | | | | | | |
| Glycerol | | | | | | |
| Ethanol | | | | 3 | 3 | 3 |
| Water | | | | bal. | bal. | bal. |
| Evaluation | | | | | | |
| Foamability | | | | A(52) | A(60) | A(65) |
| Detergency | | | | A(4) | A(4) | A(6) |
| Hand feel after washing | | | | A(+9) | A(+9) | A(+18) |

TABLE 2

| | | | | (wt %) Compositions of Invention | | | |
|---|---|---|---|---|---|---|---|
| | | | | 4 | 5 | 6 | 7 |
| Component (a) | | | | | | | |
| Alkylglycoside | $R^1$ | x | y | | | | |
| [The general formula (1)] | $C_{9-11}$ | 0 | 1.3 | 14 | 14 | 14 | 14 |

TABLE 2-continued

| | | | | (wt %) Compositions of Invention | | | |
|---|---|---|---|---|---|---|---|
| | | | | 4 | 5 | 6 | 7 |
| | $C_{12-13}$ | 0 | 1.8 | | | | |
| Component (b) (melting point) | | | | | | | |
| Carnauba wax (80–88) | | | | | | | |
| Hydroxy stearate (80–81) | | | | | | | |
| Myristyl Alcohol (36–40) | | | | | | | |
| Hydrogenated lard ($C_{16-18}$) monoglyceride (63–80) | | | | | | | |
| β-Monoolein (35.5) | | | | 10 | | | |
| Ethylene glycol distearate (60–65) | | | | | 10 | | |
| Cholesterol linolate (39–41) | | | | | | 10 | |
| Beeswax (60–67) | | | | | | | 10 |
| Other components (melting point) | | | | | | | |
| Squalane (<0) | | | | | | | |
| Linoleic acid (−5) | | | | | | | |
| Lauryl alcohol (22–25) | | | | | | | |
| β-monolinolein (12.3) | | | | | | | |
| Other components | | | | | | | |
| Amine oxide [The general formula (7): $R^{21} = C_{12}$, $R^{22} = R^{23} = C_1$ | | | | 7.0 | 3.5 | 3.5 | 3.5 |
| Polyoxyethylene (6.0) alkyl ether [alkyl group: $C_{12}$, HLB = 11.7] | | | | | | | |
| Polyoxyethylene (3.0) alkyl ether sulfate [alkyl group: $C_{12}/C_{13}$-1/1] | | | | | | | |
| Solbitol | | | | | | | |
| Glycerol | | | | | | | |
| Ethanol | | | | 3 | 3 | 3 | 3 |
| Water | | | | bal. | bal. | bal. | bal. |
| Evaluation | | | | | | | |
| Foamability | | | | A(57) | A(55) | A(52) | A(55) |
| Detergency | | | | A(5) | A(4) | A(4) | A(4) |
| Hand feel after washing | | | | A(+12) | A(+9) | A(+11) | A(+9) |

TABLE 3

| | | | | (wt %) Compositions of Invention | | | |
|---|---|---|---|---|---|---|---|
| | | | | 8 | 9 | 10 | 11 |
| Component (a) | | | | | | | |
| Alkylglycoside | $R^1$ | x | y | | | | |
| [The general formula (1)] | $C_{9-11}$ | 0 | 1.3 | | | 14 | 14 |
| | $C_{12-13}$ | 0 | 1.8 | 14 | 14 | | |
| Component (b) (melting point) | | | | | | | |
| Carnaubyl wax (80–88) | | | | | | 10 | |
| Hydroxy stearate (80–81) | | | | 10 | | | |
| Myristyl Alcohol (36–40) | | | | | | | |
| Hydrogenated lard ($C_{16-18}$) monoglyceride (63–80) | | | | | 10 | | 10 |
| β-Monoolein (35.5) | | | | | | | |
| Ethylene glycol distearate (60–65) | | | | | | | |
| Cholesterol linolate (39–41) | | | | | | | |
| Beeswax (60–67) | | | | | | | |
| Other components (melting point) | | | | | | | |
| Squalane (<0) | | | | | | | |
| Linoleic acid (−5) | | | | | | | |
| Lauryl alcohol (22–25) | | | | | | | |
| β-monolinolein (12.3) | | | | | | | |
| Other components | | | | | | | |
| Amine oxide [The general formula (7): $R^{26} = C_{12}$, $R^{27} = R^{28} = C_1$ | | | | 3.5 | 3.5 | 3.5 | 3.5 |
| Polyoxyethylene (6.0) alkyl ether [alkyl group: $C_{12}$, HLB = 11.7] | | | | | | | 7 |
| Polyoxyethylene (3.0) alkyl ether sulfate [alkyl group: $C_{12}/C_{13}$-1/1] | | | | | | | 7 |
| Solbitol | | | | | | | |
| Glycerol | | | | | | | |
| Ethanol | | | | 3 | 3 | 3 | 3 |
| Water | | | | bal. | bal. | bal. | bal. |
| Evaluation | | | | | | | |
| Foamability | | | | A(52) | A(70) | A(55) | A(80) |
| Detergency | | | | A(4) | A(6) | A(4) | A(7) |
| Hand feel after washing | | | | A(+9) | A(+18) | A(+9) | A(+15) |

TABLE 4

| | | | | (wt %) Comparative Compositions | | | |
|---|---|---|---|---|---|---|---|
| | | | | 1 | 2 | 3 | 4 |
| Component (a) | | | | | | | |
| Alkylglycoside | $R^1$ | x | y | | | | |
| [The general formula (1)] | $C_{9-11}$ | 0 | 1.3 | 14 | 14 | 14 | 14 |
| | $C_{12-13}$ | 0 | 1.8 | | | | |
| Component (b) (melting point) | | | | | | | |
| Carnauba wax (80–88) | | | | | | | |
| Hydroxy stearate (80–81) | | | | | | | |
| Myristyl Alcohol (36–40) | | | | | | | |
| Hydrogenated lard ($C_{16-18}$) monoglyceride (63–80) | | | | | | | |
| β-Monoolein (35.5) | | | | | | | |
| Ethylene glycol distearate (60–65) | | | | | | | |
| Cholesterol linolate (39–41) | | | | | | | |
| Beeswax (60–67) | | | | | | | |
| Other components (melting point) | | | | | | | |
| Squalane (<0) | | | | 10 | | | |
| Linoleic acid (−5) | | | | | 10 | | |
| Lauryl alcohol (22–25) | | | | | | 10 | |
| β-monolinolein (12.3) | | | | | | | 10 |
| Other components | | | | | | | |
| Amine oxide [The general formula (7): $R^{21} = C_{12}$, $R^{22} = R^{23} = C_1$ | | | | 3.5 | | 3.5 | 3.5 |
| Polyoxyethylene (6.0) alkyl ether [alkyl group: $C_{12}$, HLB = 11.7] | | | | | | | |
| Polyoxyethylene (3.0) alkyl ether sulfate [alkyl group: $C_{12}/C_{13}$-1/1] | | | | | | | |
| Solbitol | | | | | | | |
| Glycerol | | | | | | | |
| Ethanol | | | | 3 | 3 | 3 | 3 |
| Water | | | | bal. | bal. | bal. | bal. |
| Evaluation | | | | | | | |
| Foamability | | | | B(25) | C(18) | B(30) | B(40) |
| Detergency | | | | B(1) | C(0) | A(4) | A(5) |
| Hand feel after washing | | | | B(+5) | B(+2) | A(+1) | C(+6) |

TABLE 5

| | | | | (wt %) Comparative Compositions | | | |
|---|---|---|---|---|---|---|---|
| | | | | 5 | 6 | 7 | 8 |
| Component (a) | | | | | | | |
| Alkylglycoside | $R^1$ | x | y | | | | |
| [The general formula (1)] | $C_{9-11}$ | 0 | 1.3 | 14 | 14 | | |
| | $C_{12-13}$ | 0 | 1.8 | | | 14 | 14 |
| Component (b) (melting point) | | | | | | | |
| Carnauba wax (80–88) | | | | | | | |
| Hydroxy stearate (80–81) | | | | | | | |
| Myristyl Alcohol (36–40) | | | | | | | |
| Hydrogenated lard ($C_{16-18}$) monoglyceride (63–80) | | | | | | | |
| β-Monoolein (35.5) | | | | | | | |
| Ethylene glycol distearate (60–65) | | | | | | | |
| Cholesterol linolate (39–41) | | | | | | | |
| Beeswax (60–67) | | | | | | | |
| Other components (melting point) | | | | | | | |
| Squalane (<0) | | | | | | | |
| Linoleic acid (−5) | | | | | | | |
| Lauryl alcohol (22–25) | | | | | | | |
| β-monolinolein (12.3) | | | | | | | |
| Other components | | | | | | | |
| Amine oxide [The general formula (7): $R^{21} = C_{12}$, $R^{22} = R^{23} = C_1$ | | | | | | | 3 |
| Polyoxyethylene (6.0) alkyl ether [alkyl group: $C_{12}$, HLB = 11.7] | | | | | | | 3 |
| Polyoxyethylene (3.0) alkyl ether sulfate [alkyl group: $C_{12}/C_{13}$-1/1] | | | | | | | 5 |
| Solbitol | | | | 10 | | | |
| Glycerol | | | | | 10 | 10 | |
| Ethanol | | | | 3 | 3 | 3 | 3 |
| Water | | | | bal. | bal. | bal. | bal. |
| Evaluation | | | | | | | |
| Foamability | | | | A(70) | A(70) | A(70) | A(75) |
| Detergency | | | | A(6) | A(6) | A(6) | A(7) |
| Hand feel after washing | | | | B(+2) | B(+2) | B(+2) | B(+0) |

EXAMPLE 2

Detergent compositions for hard surfaces, which had their corresponding composition shown in Table 6, were prepared. Each of the resulting detergent compositions was evaluated in terms of its foamability and detergency in the same manner as in Example 1, and hand roughening tendency was evaluated in accordance with the following procedure:

Respective 5 wt% solutions of the inventive composition No. 12 and comparative composition No. 9 were held at 35° C. Both left and right hands of 12 panelists (extracted only from people who have realized that their hands are liable to roughen on a prior inquiry) were immersed for 20 minutes to their wrists in each of the solutions and then rinsed with water. After this process was repeated for 3 days, the condition of the hands of the panelists was judged by the naked eye according to the following criteria and the hand roughening tendency was evaluated in terms of the average mark.

In this test, it is desirable that the average mark should be 4 or higher.

5: Hand roughening was scarcely observed;
4: Hand roughening was but slightly observed;
3: Hand roughening was somewhat observed;
2: Hand roughening was considerably observed; and
1: Hand roughening was significantly observed.

TABLE 6

| | The inventive detergent composition 12 | The comparative detergent composition 9 |
|---|---|---|
| Alkylglycoside [The general formula (1): $R^1 = C_{12-13}$, x = 0, y-1.8] | 15 | 15 |
| Hydrogenated lard ($C_{16-18}$) monoglyceride | 10 | — |
| Lauryl dimethyl amine oxide | 3 | 3 |
| Polyoxyethylene(12) lauryl ether | 4 | 4 |
| Polyoxyethylene(4) alkyl ether sulfate [alkyl group: $C_{12}/C_{13}$ = 1/1] | 6 | 6 |
| Ethanol | 3 | 3 |
| Water | bal. | bal. |
| Evaluation | | |
| Foamability | A(80) | A(80) |
| Detergency | A(7) | A(7) |
| Hand roughening tendency | 4.00 | 2.67 |

* The evaluations of hand roughening between the inventive detergent composition and the comparative detergent composition were statistically meaningful based on the 0.2% significance level.

Tests as to the foamability, detergency, readhesion of smear and hand roughening tendency, which were adopted in Examples 3 and 4, will now be described.

(1) Foamability test

A commercially-available butter was added in an amount of 0.1 wt. % as a smear component to a 0.5 wt. % aqueous solution of each of the detergent compositions (hardness of water used: 3.5° DH) to determine the foamability at this time. The determination was conducted in the following manner. A glass cylinder 5 cm across was charged with 40 ml of the detergent solution with the butter added thereto. The solution was rotationally stirred for 15 minutes at 20° C. to measure the height of foam generated right after stopping the stirring.

(2) Evaluation of detergency

To beef tallow was added 0.1% of Sudan III (a red coloring matter), and a porcelain dish (diameter: 25 cm) coated with 2.5 g of this mixture was rubbed and washed at 20° C. by means of a sponge with 3 g of a detergent and 27 g of water of 3.5° DH hardness soaked therein. The detergency was evaluated in terms of the number of dishes cleansed until the beef tallow was no longer cleanly removed (referred to as "number of dishes" effectively washed).

(3) Readhesion of Smear test

In a 100-ml beaker, 100 ml of a 0.1 wt. % aqueous solution of each of the detergent compositions (hardness of water used: 3.5'DH) was prepared and then added with 0.1 g of rapeseed oil. While stirring the thus-obtained mixture by a magnetic stirrer, a clean glass slide was immersed for 10 seconds therein. The glass slide was pulled up and then immersed for 10 seconds in 100 ml of rinse water (hardness: 3.5° DH). After the rinsing, the glass slide was air-dried at room temperature to observe the adhesion condition of rapeseed oil on the glass slide. The readhesion of smear was judged by a naked eye according to the following criteria (this test was performed at 25° C.).

0: No adhesion of droplets of the oil was observed;
Δ: Adhesion of droplets of the oil was observed to a slight extent; and
x: Adhesion of droplets of the oil was observed to a marked extent.

(4) Test of hand roughening tendency

A 5 wt. % solution of each detergent composition was prepared and then held at 30° C. The hands were immersed for 20 minutes in the solution and then rinsed with water. This process was repeated for 3 days. Four days later, the condition of the hands of five panelists was judged by the naked eye according to the following criteria and the hand roughening tendency was evaluated in terms of the average mark. The criteria in this case are as follows (in this test, it is desirable that the average mark should be 4 or higher):

5: Hand roughening was scarcely observed;
4: Hand roughening was but slightly observed;
3: Hand roughening was somewhat observed;
2: Hand roughening was considerably observed; and
1: Hand roughening was significantly observed.

EXAMPLE 3

Compositions shown in Table 7 were prepared to test the detergency, foamability, feel upon use and hand roughening tendency.

The results are shown in Table 7.

TABLE 7

| | Compositions of Invention | | | | | Comparative Compositions | |
|---|---|---|---|---|---|---|---|
| | 13 | 14 | 15 | 16 | 17 | 10 | 11 |
| Component (a) | | | | | | | |
| Alkylglycoside [$R_1 = C_{12}$, x = 0, y = 1.35 G: glucose residue] | 20 | 20 | 20 | 15 | 10 | 20 | 15 |
| Component (b) | | | | | | | |

TABLE 7-continued

| | Compositions of Invention | | | | | Comparative Compositions | |
|---|---|---|---|---|---|---|---|
| | 13 | 14 | 15 | 16 | 17 | 10 | 11 |
| Glycerol hydrogenated lard fatty acid ester [content of monoglyceride = 95%, fatty acid residue $C_{16}/C_{18}$ = 1/1] | 6 | 6 | 6 | 6 | 6 | — | 1 |
| Component (c) | | | | | | | |
| Dodecyl dimethyl amine oxide | 2 | — | — | 2 | 1 | 2 | 2 |
| N,N,N-dodecyl dimethyl-N-2-hydroxy-3-sulfopropylammoniumbetaine | — | — | 5 | — | 1 | — | — |
| Diehanol amido lauric acid | — | 5 | — | 3 | — | — | 3 |
| Component (d) | | | | | | | |
| Sodium polyoxyethylene(3) dodecyl ether sulfate | 18 | — | — | 10 | 5 | 18 | 10 |
| Sodium linear alkyl benzene sulfonate (average molecular weight = 344) | — | 15 | — | 10 | — | — | 10 |
| Sodiium α-olefin sulfonate (average molecular weight = 326) | — | — | 15 | — | 5 | — | — |
| Ethanol | 5 | 5 | 5 | 5 | 5 | 5 | 5 |
| Water | bal. | bal. | bal. | bal. | bal. | bal. | bal. |
| Evaluation | | | | | | | |
| Detergency (number of dishes) | 6 | 6 | 6 | 6 | 7 | 5 | 6 |
| Foamability (mm) | 80 | 80 | 80 | 80 | 85 | 65 | 80 |
| Inhibitive ability of readhesion | 0 | 0 | 0 | 0 | 0 | 0 | 0 |
| Hand roughening tendency | 5.0 | 5.0 | 5.0 | 5.0 | 5.0 | 3.0 | 3.0 |

EXAMPLE 4

Component (b) was changed as shown in Table 8 to test the detergency, foamability, feel upon use and hand roughening tendency.

The results are shown in Table 8.

TABLE 8

| | | (wt %) | | | |
|---|---|---|---|---|---|
| | | Compositions of invention | | Comparative Compositions | |
| | | 18 | 19 | 12 | 13 |
| Component (a) | | | | | |
| Alkylglycoside [$R_1 = C_{10}$, x = 0, y-1.2, G: glucose reside] | | 10 | 10 | 10 | 10 |
| Component (b) | | | | | |
| The number of carbon atoms of fatty acid residue | The content of monoglyceride | | | | |
| 10 | 95% | — | — | 8 | — |
| 12 | 90 | — | — | — | 8 |
| 16 | 95 | 8 | — | — | — |
| 22 | 90 | — | 8 | — | — |
| Component (c) | | | | | |
| Tetradecyl dimethyl amine oxide | | 5 | 5 | 5 | 5 |
| Component (d) | | | | | |
| Sodium polyoxyethylene(4) dodecyl ether sulfate | | 15 | 15 | 15 | 15 |
| Ethanol | | 5 | 5 | 5 | 5 |
| Water | | bal. | bal. | bal. | bal. |
| Evaluation | | | | | |
| Detergency (number of dishes) | | 6 | 6 | 6 | 6 |
| Foamability (mm) | | 80 | 80 | 80 | 80 |
| Inhibitive ability of readhesion | | ○ | ○ | ○ | Δ |
| Hand roughening tendency | | 5.0 | 5.0 | 3.5 | 3.5 |

What is claimed is:

1. A milky detergent composition for hard surfaces consisting essentially of, based on the total weight of the composition, the following components (a), (b) and (c):

(a) 5–30 wt. % of an alkylglycoside;

(b) 3–15 wt. % of one or more partial esters of aliphatic hydrocarbon polyols selected from the group consisting of glycerol, ethylene glycol, propylene glycol, and dimers and trimers of glycerol, ethylene glycol, and propylene glycol, with fatty acids having at least 16 carbon atoms on the average, said esters having a melting point of 50° C. or higher; and (c) 1–10 wt. % of one or more amine oxide surfactants.

2. The milky detergent composition of claim 1, wherein component (b) is a partial ester of glycerol with fatty acids having at least 16 carbon atoms on average.

3. The milky detergent composition of claim 1, wherein component (b) is a mixture of partial esters of glycerol in which the fatty acid residues have 16–24 carbon atoms and whose content of monoester is 75–100 wt. %.

4. The milky detergent composition of claim 1, wherein the alkylglycoside of the component,(a) is a compound represented by the following general formula (1):

$$R^1(OR^2)_xG_y \quad (1)$$

wherein $R^1$ is a linear or branched alkyl, alkenyl or alkylphenyl group having 8–18 carbon atoms, $R^2$ denotes an alkylene group having 2–4 carbon atoms, G represents a residue derived from a reducing sugar having 5–6 carbon atoms, x stands for a number of 0–5 and is an average value, and y is a number of 1–10 and is an average value.

5. A milky detergent composition for hard surfaces, which comprises the following components (a) through (d):

(a) 5–30 wt. % of an alkylglycoside represented by the following general formula (1):

$$R^1(OR^2)_xG_y \quad (1)$$

wherein $R^1$ is a linear or branched alkyl, alkenyl or alkylphenyl group having 8–18 carbon atoms, $R^2$ is an alkylene group having 2–4 carbon atoms, G represents a residue derived from a reducing sugar having 5–6 carbon atoms, x stands for a number of 0–5 and is an average value, and y is a number of 1.0–1.42 and is an average value;

(b) 3–15 wt. % of partial esters of glycerol in which the fatty acid residues have 16–24 carbon atoms and whose content of monoester is 75–100%;

(c) 1–10 wt. % of an amine oxide surfactant; and (d) 1–40 wt. % of an anionic surfactant, the sum of said components (a), (c) and (d) being 7–40 wt. % based on the total weight of the composition.

6. The milky detergent composition of claim 5, wherein said nitrogen- containing surfactant is selected from the group consisting of fatty acid amides, amine oxides, sulfobetaines, carbobetaines and alkyl amides, and said anionic surfactant is selected from the group consisting of polyoxyalkylene alkyl ether sulfates or alkyl sulfate, alkylbenzene sulfonates, salts of alpha-sulfofatty acid esters, alpha-olefinsulfonates and alkanesulfonates.

7. A milky detergent composition for hard surfaces consisting essentially of, based on the total weight of the composition, the following components (a), (b), (c) and (d):

(a) 5–30 wt. % of an alkylglycoside;

(b) 3–15 wt. % of one or more partial esters of aliphatic hydrocarbon polyols selected from the group consisting of glycerol, ethylene glycol, propylene glycol, and dimers and trimers of glycerol, ethylene glycol, and propylene glycol, with fatty acids having at least 16 carbon atoms on the average, said esters having a melting point of 50° C. or higher;

(c) 1–10 wt. % of one or more amine oxide surfactants; and (d) an anionic surfactant in a proportion of 1–40 wt. % based on the total weight of the composition.

8. The milky detergent composition of claim 7, wherein the anionic surfactant is selected from the group consisting of polyoxyalkylene alkyl ether sulfates or alkyl sulfates, alkylbenzene sulfonates, salts of alpha-sulfofatty acid esters, alpha-olefinsulfonates and alkanesulfonates.

9. A milky detergent composition for hard surfaces consisting essentially of, based on the total weight of the composition, 3–5 wt. % ethanol, water and the following components (a), (b) and (c):

(a) 5–30 wt. % of an alkylglycoside;

(b) 3–15 wt. % of one or more partial esters of aliphatic hydrocarbon polyols selected from the group consisting of glycerol, ethylene glycerol, and dimers and a trimers of glycerol, ethylene glycol, and propylene glycol, with fatty acids having at least 16 carbon atoms on the average, said esters having a melting point of 50° C. or higher; and (c) 1–10 wt. % of one or more amine oxide surfactants.

10. The milky detergent composition of claim 1, wherein the ratio of component (b) to component (a) is at least $\frac{1}{3}$ by weight.

11. The milky detergent composition of claim 1, wherein the weight ratio of component (b) to component (a) is higher than $\frac{1}{2}$.

12. The milky detergent composition of claim 7, wherein the ratio of component (b) to component (a) is between $\frac{1}{3}$ by weight.

13. The milky detergent composition of claim 7, wherein the weight ratio of component (b) to component (a) is higher than $\frac{1}{2}$.

14. The milky detergent composition of claim 9, wherein the ratio of component (b) to component (a) is at least $\frac{1}{3}$ by weight.

15. The milky detergent composition of claim 9, wherein the weight ratio of component (b) to component (a) is higher than $\frac{1}{2}$ but not higher than 5/1.

16. The milky detergent composition of claim 1, wherein the one or more amine oxide surfactants are selected from compounds having the formula (7):

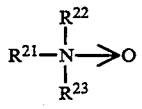

(7)

wherein $R^{21}$ is a linear or branched alkyl or alkenyl group having 8–16 carbon atoms, and $R^{22}$ and $R^{23}$, which may be the same or different, are a methyl or ethyl group.

17. The milky detergent composition of claim 5, wherein the one or more amine oxide surfactants are selected from compounds having the formula (7):

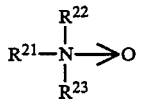

(7)

wherein $R^{21}$ is a linear or branched alkyl or alkenyl group having 8–16 carbon atoms, and $R^{22}$ and $R^{23}$, which may be the same or different, are a methyl or ethyl group.

18. The milky detergent composition of claim 7, wherein the one or more amine oxide surfactants are selected from compounds having the formula (7):

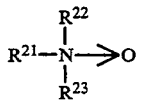

(7)

wherein $R^{21}$ is a linear or branched alkyl or alkenyl group having 8–16 carbon atoms, and $R^{22}$ and $R^{23}$, which may be the same or different, are a methyl or ethyl group.

19. The milky detergent composition of claim 9, wherein the one or more amine oxide surfactants are selected from compounds having the formula (7):

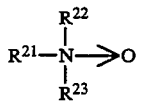

(7)

wherein $R^{21}$ is a linear or branched alkyl or alkenyl group having 8–16 carbon atoms, and $R^{22}$ and $R^{23}$, which may be the same or different, are a methyl or ethyl group.

20. A milky detergent composition for hard surfaces consisting essentially of:

(a) 5–30 wt. % of an alkylglycoside;

(b) 3–15 wt. % of one or more partial esters of aliphatic hydrocarbon polyols selected from the group consisting of glycerol, ethylene glycerol, and dimers and trimers of glycerol, ethylene glycol and propylene glycol, with fatty acids having at least 16 carbon atoms on the average, said esters having a melting point of at least 50° C.; and (c) 1–10 wt. % of one or more amine oxide surfactants selected from compounds having the formula (7):

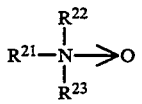

(7)

wherein $R^{21}$ is a linear or branched alkyl or alkenyl group having 8–16 carbon atoms, and $R^{22}$ and $R^{23}$, which may be the same or different, are a methyl or ethyl group.

* * * * *